US008135142B2

(12) United States Patent
Fischer et al.

(10) Patent No.: US 8,135,142 B2
(45) Date of Patent: Mar. 13, 2012

(54) METHOD FOR REDUCING INTERFERENCES OF A DIRECTIONAL MICROPHONE

(75) Inventors: Eghart Fischer, Schwabach (DE); Henning Puder, Erlangen (DE)

(73) Assignee: Siemens Audiologische Technic GmbH, Erlangen (DE)

( * ) Notice: Subject to any disclaimer, the term of this patent is extended or adjusted under 35 U.S.C. 154(b) by 1131 days.

(21) Appl. No.: 11/263,429

(22) Filed: Oct. 31, 2005

(65) Prior Publication Data

US 2006/0104459 A1 May 18, 2006

(30) Foreign Application Priority Data

Nov. 2, 2004 (DE) ..... 10 2004 052 912

(51) Int. Cl.
*H04R 3/00* (2006.01)
*H04R 1/40* (2006.01)
*G10K 11/16* (2006.01)

(52) U.S. Cl. ..... 381/92; 381/122; 381/71.11; 381/97

(58) Field of Classification Search ..... 381/122, 381/313, 97–98, 91–92, 71.11
See application file for complete search history.

(56) References Cited

U.S. PATENT DOCUMENTS

| | | | | |
|---|---|---|---|---|
| 5,224,170 | A * | 6/1993 | Waite, Jr. | 381/92 |
| 7,577,262 | B2 * | 8/2009 | Kanamori et al. | 381/94.7 |
| 2003/0169891 | A1 * | 9/2003 | Ryan et al. | 381/92 |
| 2004/0058662 | A1 * | 3/2004 | Gieske et al. | 455/313 |
| 2005/0008166 | A1 | 1/2005 | Fischer et al. | |

FOREIGN PATENT DOCUMENTS

| | | |
|---|---|---|
| DE | 103 27 889 | 9/2004 |
| WO | WO 01/01731 A1 | 1/2001 |

OTHER PUBLICATIONS

Douglas, S.C. "Introduction to Adaptive Filters" Digital Signal Processing Handbook, E.D. Vijay K. Madisetti and Douglas B. Williams Boca Raton: CRC Press LLC, 1999 [http://dsp-book.narod.ru/DSPMW/18.PDF].*

* cited by examiner

*Primary Examiner* — Devona Faulk
*Assistant Examiner* — George Monikang

(57) ABSTRACT

The interference powers with directional microphones are to be suppressed as far as possible. To this end, provision is made to adaptively filter the microphone of a number of microphones as a function of at least one parameter. The directional effect of the directional microphone achieved in this way is adjusted by modifying the at least one parameter, such that the summation of interference powers including microphone noises is reduced and/or minimal.

6 Claims, 5 Drawing Sheets

METHOD FOR REDUCING INTERFERENCES OF A DIRECTIONAL MICROPHONE

CROSS REFERENCE TO RELATED APPLICATIONS

This application claims priority to the German application No. 10 2004 052 912.4, filed Nov. 2, 2004 which is incorporated by reference herein in its entirety.

FIELD OF INVENTION

The present invention relates to a method for reducing interference powers with a directional microphone by means of providing at least two microphone signals adaptive filtering of the at least two microphone signals to achieve a directional effect, with at least one adaptation parameter being able to be optimized. Furthermore, the present invention relates to a corresponding acoustics system with a directional microphone.

BACKGROUND OF INVENTION

With acoustic systems essentially and in particular with hearing devices, a plurality of microphone signals are required to be combined spatially and filtered spectrally such that the output signal has the fewest possible interference components. In this case interferences are defined on the one hand as the signals, which occur due to undesired directions, in this case outside a specific angle range around the 0° direction, e.g. +/−60°, and on the other hand as a microphone noise, which can be amplified particularly in low frequency ranges, during the development of the directional effect. In particular, the problem here is that the microphone noise increases if the directional effect of a directional microphone is increased.

SUMMARY OF INVENTION

Approaches to suppressing interference signals exist for first order directional microphones. However, these only address the aspect of suppressing external interferers by adjusting so-called notches (regions of high attenuation).

Furthermore, a method is available according to the publication WO 01/01731 A1, which generates an omni characteristic with a low microphone noise by means of parameter selection. Provision is thus not made here for a suppression of interference signals.

The known solution is disadvantageous in that no common approach for the simultaneous optimization of the summation power of microphone noise and signal sources occurring due to undesired directions is available. To this end, no solution exists in particular for second order directional microphones.

Patent specification DE 103 27 889 B3 discloses a hearing aid device with a microphone system, in which different directional characteristics can be adjusted. A higher degree of directional effect however also increases the microphone noise caused by the microphone system. A compromise between the strength of the directional effect and the maximum microphone noise accepted must therefore always be found. The hearing aid wearer must nevertheless find the compromise himself, at least he must assist with it.

An object of the present invention is thus to propose a method for reducing interference powers with a directional microphone, in which both the microphone noise and also the signal powers of interference sources are accounted for. Furthermore, a corresponding acoustics system is to be specified.

In accordance with the invention, this object is achieved by means of a method for reducing interference power with a directional microphone by providing at least two microphone signals and an adaptive filter of the at least two microphone signals to achieve a directional effect, with at least one adaptation parameter being able to be optimized, and adjusting the directional effect by means of modifying the at least one adaptation parameter such that the summation of interference powers is reduced. As mentioned, the interference powers consist of microphone noises and powers of unwanted signal sources. Interference and noise sources can thus be equally accounted for. The directional microphone is thus arranged in a predetermined direction, in particular in the 0° direction and signal sources are considered as undesired if they lie outside a predetermined angle around the predetermined direction. The adjustment of the adaptive filter allows the angle ranges to be defined, in which acoustic sources are treated as interference sources. In this case, the at least one adaptation parameter of the filter device is modified such that the complete output signal power is minimized, with the signal from the predetermined and/or 0° direction not however being modified. The reduction of the output signal power also automatically reduces the interference power, the amplification in the main incident direction thus remaining unaffected.

Furthermore, provision is made according to the invention for a corresponding acoustics system.

The invention advantageously guarantees an uninfluenced signal from the 0° direction in combination with an adaptation method which effects a minimization of the sum of the interfering signals.

Advantageously the filters of the filter device are first or second order adaptive FIR filters (Finite Impulse Response). This allows an adaptive directional microphone of high quality to be achieved.

With a particularly preferred embodiment, the interference powers are reduced in a number of sub bands. In this way the interference powers can be reduced selectively in different frequency ranges.

BRIEF DESCRIPTION OF THE DRAWINGS

The present invention is described in further detail below with reference to the attached drawings, in which.

DETAILED DESCRIPTION OF INVENTION

The exemplary embodiments illustrated in further detail below represent preferred embodiments of the present invention.

Figure 1:
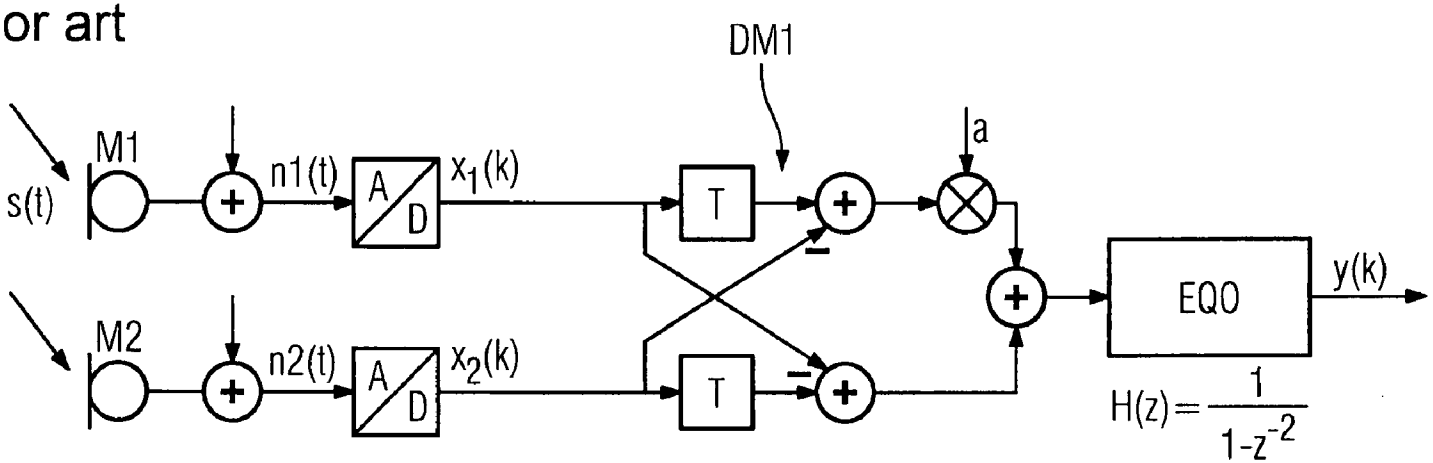
FIG 1 Prior art
FIG. 1 shows a basic circuit diagram of a first order differential microphone according to the prior art.

To aid understanding of the present invention, a first order differential microphone according to the prior art is first explained with reference to FIG. 1. Two microphones M1 and M2 receive a time-dependent acoustic signal s(t). A microphone noise signal n1(*t*) and/or n2(*t*) is added in each instance to the ideal microphone sign als. The respective summation signals are digitalized with an analogue digital converter thereby resulting in microphone signals $x_1(k)$ and $x_2(k)$. A first order differential microphone subtracts the two microphone signals $x_1(k)$ and $x_2(k)$ in a crosswise fashion, as is known for directional microphones. In this case, the signals are delayed in the corresponding paths with timing elements T and a difference signals is multiplied with an adaptation parameter a. The resulting signals are added and supplied to an equalizer EQ0 with the transmission function $$H(z) = \frac{1}{1 - z^{-2}}$$

for equalization purposes. The equalization supplies a mono output signal y (k).

The first order differential microphone DM1 allows $1+az^{-1}$ und $-a-z^{-1}$ to be implemented by means of two FIR filters FIR1 and FIR2 with the transmission functions. This is schematically reproduced in FIG. 2. The filter coefficients can thus not be freely selected but instead depend on the parameter a. This dependency, which results from the conversion of the filter from the differential microphone DM1, ensures that after the directional microphone processing, the output signal contains the signal from the 0° direction (user signal direction) in an unchanged manner, as a function of the selection of the parameter a. To optimize the parameter a, this must be adapted to the respective acoustic situation.

Figure 3:
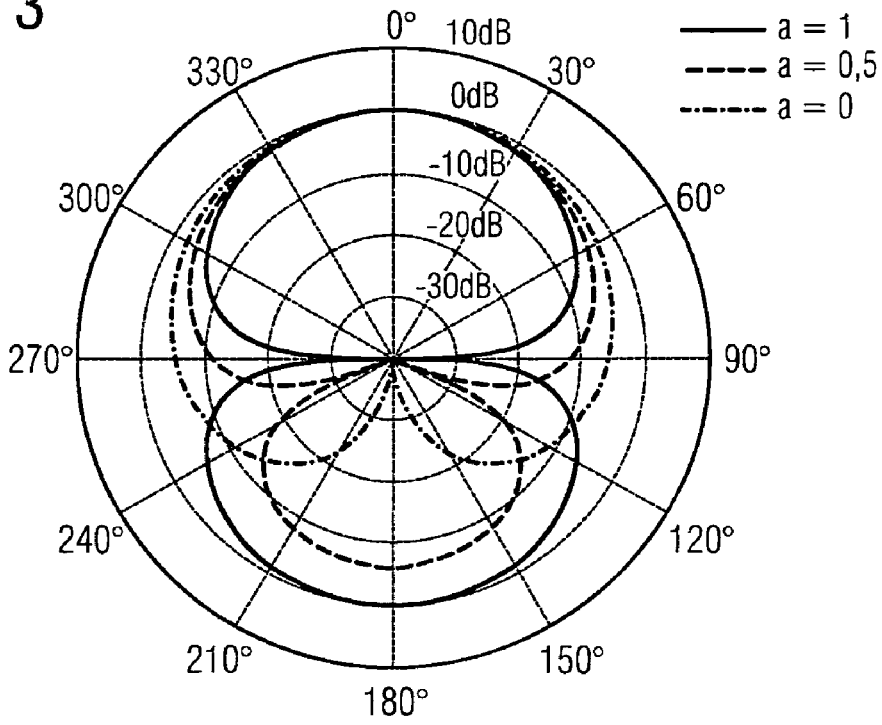
FIG. 3 shows a directional diagram for the differential microphone in FIG. 1.

FIG. 3 shows the effect of the parameter a in a directional diagram. With a=0 the sound is attenuated from direction 180°. With an increasing a, the notches (directions of the most intense attenuations) travel forwards.

Figure 4:
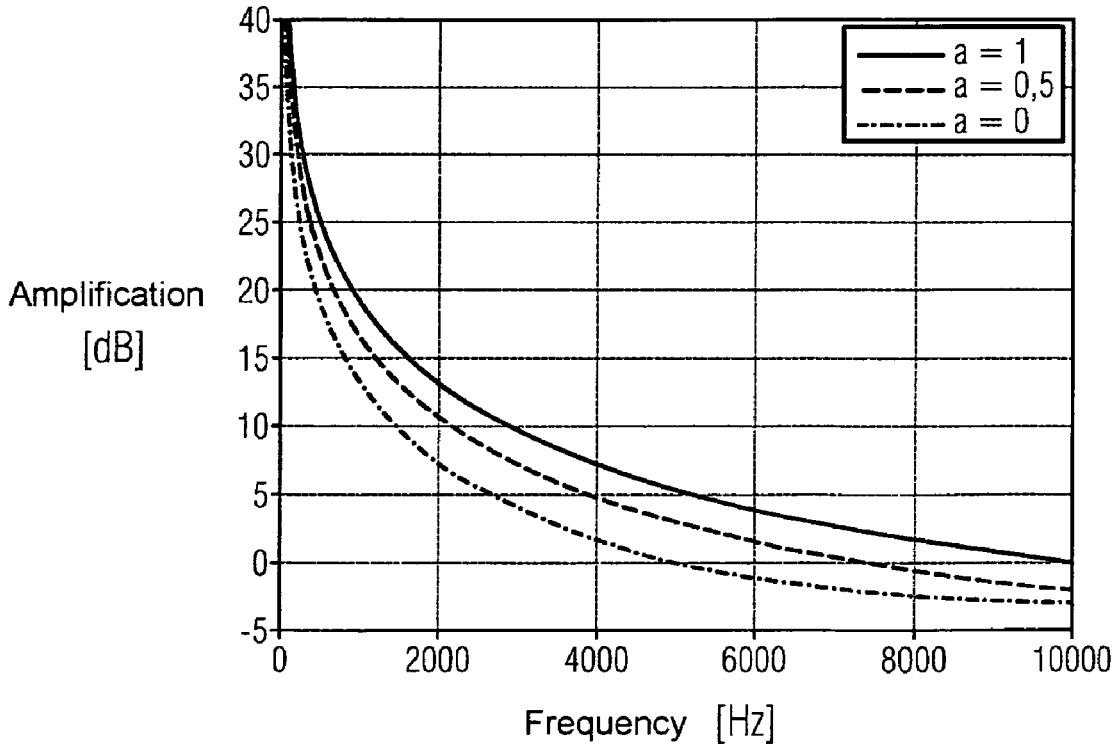
FIG. 4 shows the dependency of the microphone noise on the frequency and the directional effect.

FIG. 4 shows how the microphone noise also increases with an increasing a.

Figure 5:
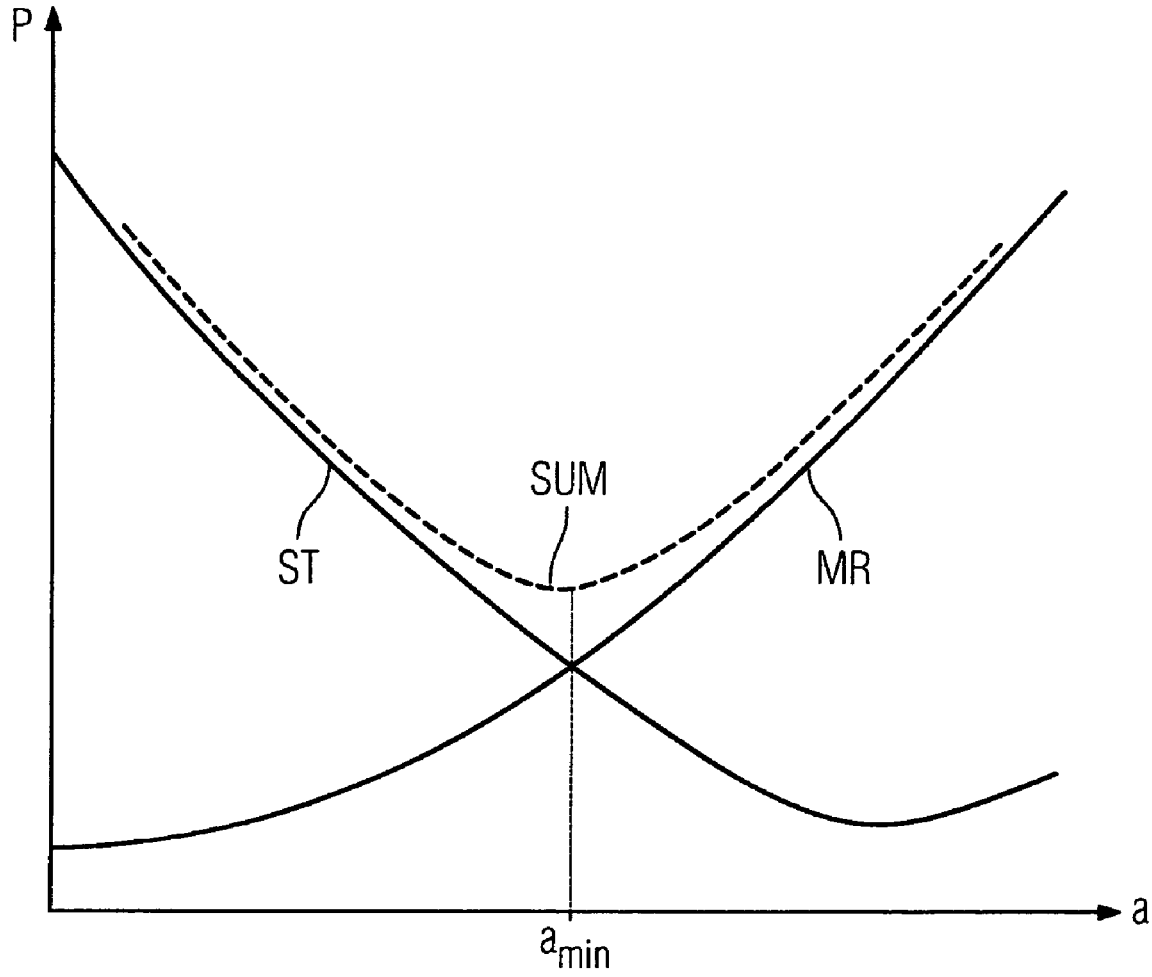
FIG. 5 shows a diagram to optimize the adaptation parameter.

The aim now is to keep the overall interference power of a directional microphone as low as possible. Therefore on the one hand the directional effect of the directional microphone is to be adjusted such that the sound of an interference source is suppressed as much as possible and on the other hand the microphone noise is as low as possible. To this end, FIG. 5 shows the power of the interference signal ST and the microphone noise qualitatively via the parameter a. A summation signal SUM from the two signals ST and MR represents the overall interference power for the directional microphone. The aim here is to find the minimum of this curve and to use the corresponding parameter value $a_{min}$ for the adaptive filter.

To adapt the directional microphone, the minimization of the average output signal power is therefore only possible because the special selection of the filter coefficients as a function of the parameter a ensures that the user signal is not modified from the 0° direction. The minimization of the complete power (user signal and interference) is thus equivalent to the minimization of the power of the interference. The interference thus consists of two components; microphone noise and interference from signal sources occurring due to unwanted directions. An attenuation of direction-dependent signal sources can be achieved by selecting the parameter a>0. The restriction to a maximum value, e.g. 2, determines the range in the 0° direction, in this case +/−60° in which occurring signal sources are not attenuated or only slightly. If the adaptive method additionally allows the parameters to be selected smaller than 0, the directional effect is reduced but the power of the microphone noise is thus also reduced. By adapting the parameters into individual frequency bands, the method allows the summation of interference powers, i.e. of microphone noises and of signal sources from undesired directions, to be minimized in each frequency band.

The parameter a can be located by determining the minimum of the average quadratic error. This means that the expectation value of the output signal is to be minimal, i.e.

$$E\{|y(k)|^2\}^1=\min$$

This results in a simple and robust method for adaptive first order directional microphones.

Figure 6:
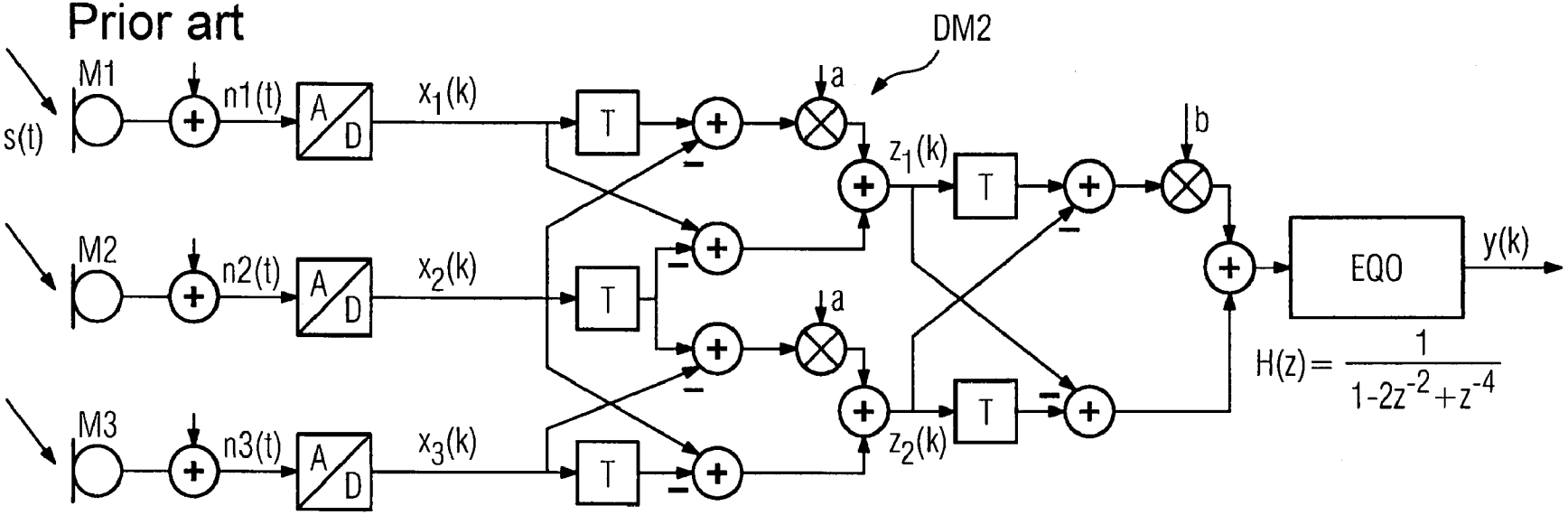
FIG 6 Prior art
FIG. 6 shows a basic circuit diagram of a second order differential microphone according to the prior art.

In addition to the microphones M1 and M2, a second order dire ctional microphone according to FIG. 6 has a third microphone M3. The output sign al of said third microphone is also disturbed by means of microphone noise n3(*t*) and the corresponding summation signal is digitally converted into a microphone output signal $x_3(k)$. The second order DM2 differential microphone generates an output signal y(k) according to the conventional equalization EQ0 from the three microphone signals $x_1(k)$, $x_2(k)$ and $x_3(k)$. In this case, in a first stage, the microphone signals are subtracted in a crosswise fashion according to the corresponding time delay T and a signal weighting with the factor a takes place in two sub branches, so that the two intermediate signals $z_1(k)$ and $z_2(k)$ result. Similarly to the first order differential microphone according to FIG. 1, [lacuna] in a second step from the intermediate signals z1(*k*) and $z_2(k)$ for the equalizer in 0° direction, which features the transmission function $$H(z) = \frac{1}{1 - 2z^{-2} + z^{-4}}$$

here.

The output signal of the equalizer EQ0 is also indicated using y(k).

Figure 2:
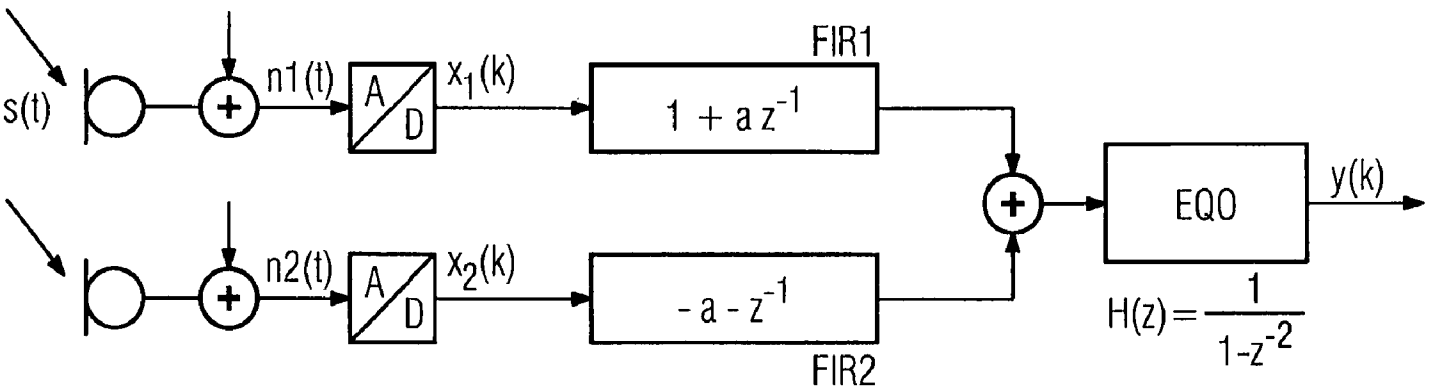
FIG. 2 shows a circuit diagram equivalent to FIG. 1 with two FIR filters.
Figure 7:
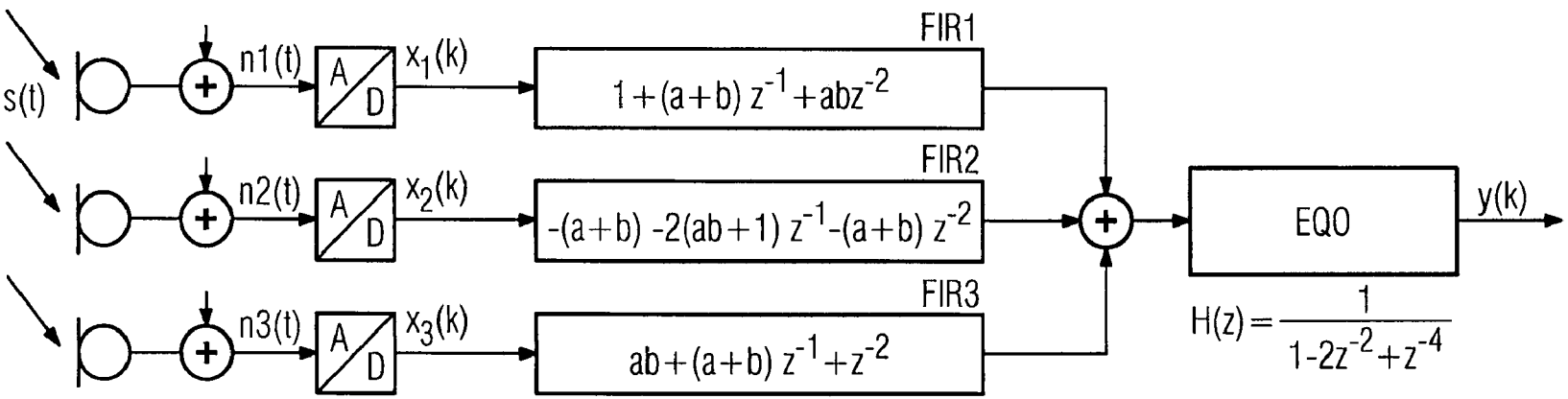
FIG. 7 shows a circuit diagram equivalent to FIG. 6 with three FIR filters.

The second order differential microphone can be described in a similar manner to the first order differential microphone by means of three FIR filters as shown in FIG. 7, (cf. also FIG. 2). In this case, the first FIR filter FIR1 has the transmission function $$1+(a+b)z^{-1}-abz^{-2}$$

The second filter FIR2 has the transmission function $$-(a+b)-2(ab+1)z^{-1}-(a+b)z^{-2}$$

And the third filter FIR3 has the transmission function $$ab+(a+b)z^{-1}+z^{-2}$$

The minimum of the average quadratic error of the output signals is also to be calculated for the determination of the two parameters a and b, i.e.

$$E\{|y(k)|^2\}^1=\min$$

Figure 8:
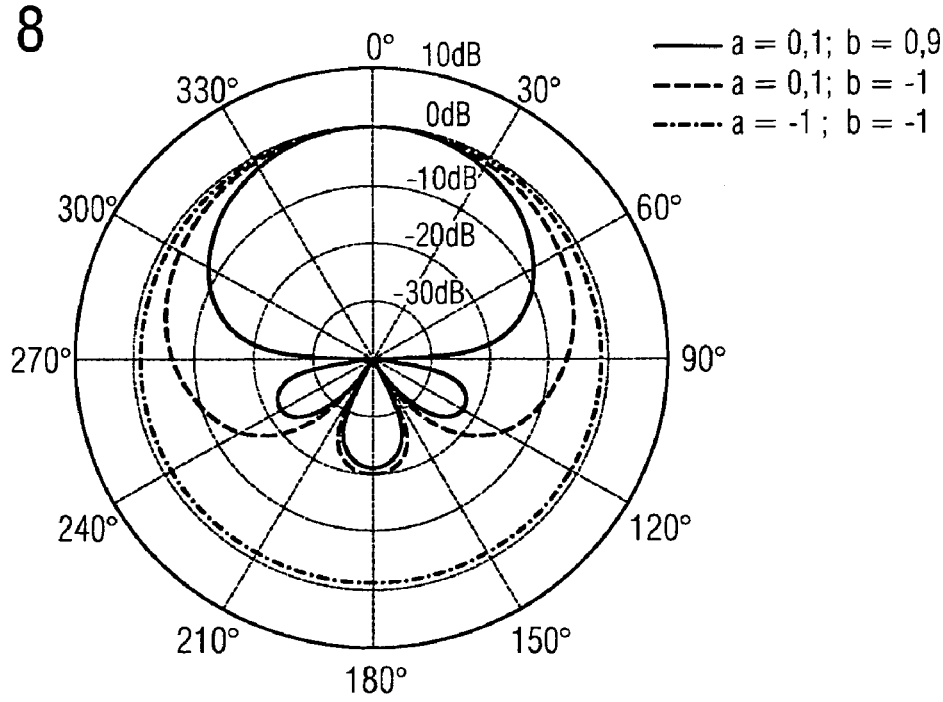
FIG. 8 shows a directional diagram of the differential microphone in FIG. 6.
Figure 9:
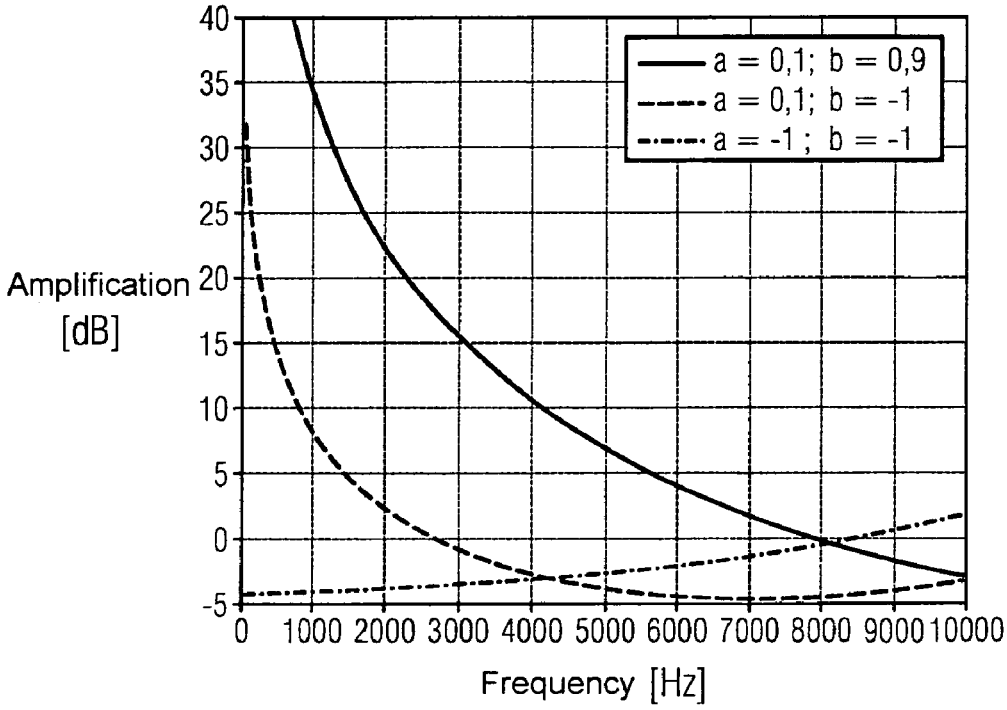
FIG. 9 shows the dependency of the microphone noise on the frequency and the adaptation parameters for the second order differential microphones.

For a concrete interference situation, specific parameters a and b thus result, thereby minimizing the overall interference power. The effects of the two parameters a and b can be seen in the directional diagram of FIG. 8. The values a=−1 b=−1 almost result in an omni characteristic of the directional microphone, as is indicated by the dotted line in FIG. 8. With the values a=0,1 b=0,9 in 0° direction a pronounced dire ctional characteristic results however. With the second order directional microphone the microphone noise also increases with increasing directional effect, as was used for the same parameter combinations in FIG. 8 and displayed in FIG. 9.

The above determined parameters a and b also result here in the desired compromise between directional effect and microphone noises corresponding to FIG. 5, in which the complete signal interference power is minimal.

The method additionally has an increased robustness in terms of error adjustment (Mismatch) of the microphones and/or error adjustment by means of head influences of a hearing aid wearer or a headset wearer for instance. In this case, the adaptive method selects the parameter such that the complete interference power is again reduced. In the extreme case, the selection of the parameter, by means of which the spatial attenuation can be achieved without mismatch, is then automatically prevented in favor of the microphone noises. The reason for this is that the spatial attenuation can not be configured by means of the mismatch. To this end, in contrast, a permanent, non-adaptive directional microphone which attempts to achieve the maximum directional effect, can allow a spatial attenuation (attenuation in one or a number of spatial directions) to be configured by means of mismatch, microphone noises are additionally still amplified.

The invention claimed is:

1. A method of reducing interference powers in a directional microphone system, comprising:

acquiring at least first and second microphone signals from respective first and second microphones, wherein interference powers comprising both microphone noise MR and interfering signals ST produced by undesired sources originating outside a predetermined angular range around a predetermined direction relative to the first and second microphones are undesired components of the first and second signals;

applying an adaptive filtering algorithm to the first and second microphone signals via adaptive filters for establishing a directional effect, the adaptive filters having filter coefficients that depend on an adaptation parameter adjustable for optimization purposes, wherein the adaptation parameter is selected to be a parameter value $a_{min}$ which corresponds to a minimum of a summation SUM of interference powers including—microphone noise MR and interfering signals ST, the summation SUM of interference powers varying as a function of the adaptation parameter, and wherein the filter coefficients being adjusted in accordance with the selection of the adaptation parameter ensures that a signal power for signals originating from the predetermined direction and acquired by the directional microphone system is not reduced.

2. The method according to claim 1, wherein the adaptive filtering algorithm includes first or second order FIR filters.

3. The method according to claim 1, wherein the microphone noise power and the power associated with the interfering signals are distributed among a plurality of frequency bands, and the method is applied to each of the frequency bands separately.

4. An acoustics system, comprising:

a directional microphone system having at least first and second microphones for generating at least first and second microphone signals, wherein interference powers comprising both microphone noise MR and interfering signals ST produced by undesired sources originating outside a predetermined angular range around a predetermined direction relative to the first and second microphones are undesired components of the first and second signals;

adaptive filters configured to apply an adaptive filtering algorithm to the first and second microphone signals for establishing a directional effect, the adaptive filters having filter coefficients that depend on at least one adaptation parameter adjustable for optimization purposes, wherein the adaptation parameter is selected by a computing device to be a parameter value $a_{min}$ which corresponds to a minimum of a summation SUM of interference powers including microphone noise MR and interfering signals ST, the summation SUM of the interference powers varying as a function of the adaptation parameter, wherein the filter coefficients being adjusted in accordance with the selection of the adaptation parameter ensures that a signal power for signals originating from the predetermined direction and acquired by the directional microphone system is not reduced.

5. The acoustics system according to claim 4, wherein the adaptive filtering algorithm includes first or second order FIR filters.

6. The acoustics system according to claim 4, wherein the filter device comprises a plurality of filters each corresponding to a frequency sub band of a plurality of frequency sub bands so that a reduction of the microphone noise power and the power associated with the interfering signals is separately implemented in each of the frequency sub bands by independently adjusting each adaptation parameter of the filter device.

* * * * *